United States Patent [19]

Jackson

[11] 4,229,966

[45] Oct. 28, 1980

[54] ADJUSTABLE HOLDER FOR THE STATIONARY DIE OF A THREAD ROLLING MACHINE

[76] Inventor: Warren M. Jackson, 5071 Crofton, Rockford, Ill. 61101

[21] Appl. No.: 22,927

[22] Filed: Mar. 22, 1979

[51] Int. Cl.[3] ..... B21H 3/06

[52] U.S. Cl. ..... 72/469; 72/90

[58] Field of Search ..... 72/90, 469, 88

[56] References Cited

U.S. PATENT DOCUMENTS 2,548,137 4/1951 Appleton ..... 72/90

3,926,026 12/1975 Jackson ..... 72/90

*Primary Examiner*—Milton S. Mehr

*Attorney, Agent, or Firm*—Leydig, Voit, Osann, Mayer & Holt, Ltd.

[57] ABSTRACT

The stationary die of a thread rolling machine is mounted in a holder which enables the stationary die to be tilted relative to the movable die about an axis which coincides with the upper edge of the thread forming face of the stationary die. The upper edge of the die thus stays stationary when the die is tilted and remains in a fixed position relative to a track which guides fastener blanks between the dies.

4 Claims, 4 Drawing Figures

ADJUSTABLE HOLDER FOR THE STATIONARY DIE OF A THREAD ROLLING MACHINE

BACKGROUND OF THE INVENTION

This invention relates to a holder for the stationary die of a thread rolling machine of the type in which a movable die is reciprocated back and forth past the stationary die to form threads on the shanks of fastener blanks which are fed successively between the dies. A thread rolling machine of this general type is disclosed in Jackson U.S. Pat. No. 3,926,026.

In such a machine, the fastener blanks usually are delivered to the dies along a slotted track which terminates adjacent one end of the stationary die. Each time the movable die is retracted, a pusher engages the leading blank in the track and feeds such blank into the gap between the dies. To enable proper feeding of the blank, it is necessary that the end of the track be precisely positioned relative to the upper edge of the thread forming face of the stationary die.

Most screws blank are made on a cold forming machine. When the dies of the cold forming machine are new, the shanks of the blanks usually are cylindrical. But, as the dies of the cold forming machine wear, the shanks of the blanks may be formed with a noncylindriical shape and may taper from the head of the shank to the tip thereof. Accordingly, different batches of blanks of the same nominal size may have different shapes. To compensate for the different shapes and enable the threads to be properly rolled, it is necessary from time to time to tilt the stationary die of the thread rolling machine relative to the movable die. If, for example, the thread rolling machine is changed over from running a batch of cylindrical blanks to running a batch of tapered blanks, it is necessary to tilt the lower portion of the stationary die toward the movable die in order to accommodate the taper.

SUMMARY OF THE INVENTION

The general aim of the present invention is to provide a new and improved die holder which enables the stationary die of the thread rolling machine to be quickly and easily tilted relative to the movable die while maintaining precise positioning between the feed track and the upper edge of the thread forming face of the stationary die.

A related object of the invention is to provide a die holder which permits tilting of the staionary die without need of adjusting the feed track and without need of adjustably shimming the stationary die or otherwise making trial and error adjustments to establish the proper positioning between the track and the die.

A more detailed object is to achieve the foregoing by providing a die holder which permits the stationary die to be tilted about an axis which coincides with the upper edge of the thread forming face to the stationary die so that such edge remains in a fixed position relative to the feed track regardless of the tilted position of the die.

In even a more specific sense, the invention resides in the provision of a die holder having relatively adjustable blocks formed with curved surfaces which enable the stationary die to be tilted without changing the position of the upper edge of the thread forming face of the die.

The invention is further characterized by the comparatively simple means used to effect relative adjustment of the two blocks of the die holder while keeping the blocks in snug engagement with one another at all times.

These and other objects and advantages of the invention will become more apparent from the following detailed description when taken in conjunction with the accompanying drawings.

DETAILED DESCRIPTION OF THE PREFERRED EMBODIMENT

Figure 1:
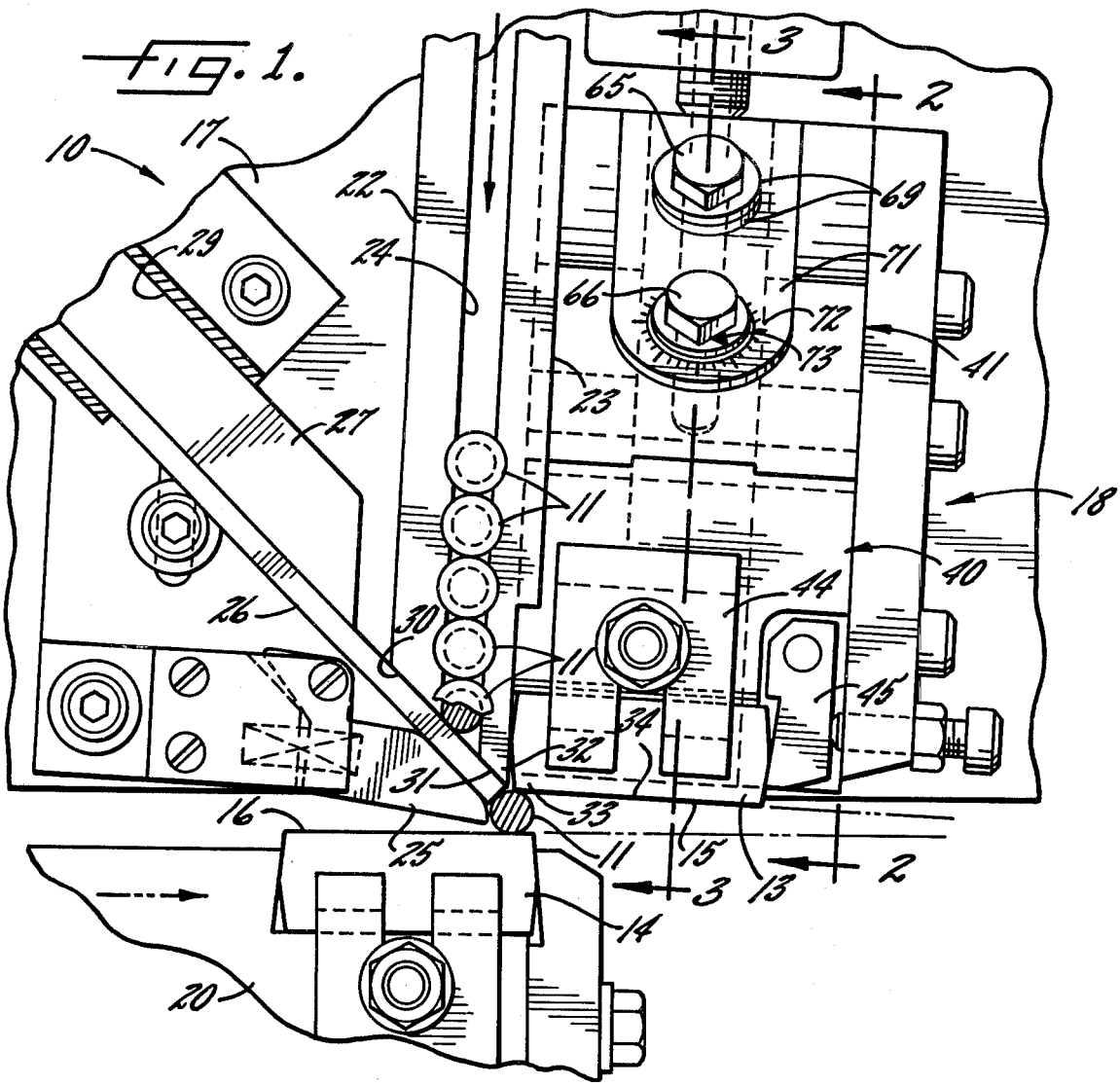
FIG. 1 is a fragmentary top plan view of a typical thread rolling machine equipped with a new and improved die holder incorporating the unique features of the present invention.

As shown in the drawings for purposes of illustration, the invention is embodied in a flat die thread rolling machine 10 for forming threads on the shanks of generally cylindrical blanks 11 which ultimately become threaded fasteners. The blanks are fed one at a time between a stationary die 13 and a movable die 14 and the threads are formed as the movable die reciprocates past the stationary die to roll the blank along and between the oposing faces 15 and 16 of the dies. The dies 13 and 14 are generally block-shaped and their opposing faces 15 and 16 are formed with longitudinally extending thread forming elements in the form of alternating flutes and grooves which extend along the faces in accordance with the helix angle of the thread to be formed.

A machine of the same general type as the machine 10 is disclosed in the aforementioned Jackson patent to which reference may be had for details of construction and operation. Briefly, the machine 10 includes a main frame (not shown) upon which is mounted a flat base plate 17. A die holder 18 for supporting the stationary die 13 is mounted on an adjustable plate 19 (FIG. 2) which, in turn, is supported by the base plate 17. In the actual machine, the base plate is usually inclined downwardly and forwardly as disclosed in the aforementioned Jackson patent. For purposes of simplicity, however, the machine has been shown and will be described as though the base plate were disposed horizontally.

The movable die 15 is supported by a slidably guided die holder 20 (FIG. 1) adapted to be reciprocated back and forth past the stationary die 13. When the movable die is at one extreme end of its stroke, its leading end is located adjacent one end of the fixed die 13 and in a position where a fastener blank 11 may be fed between the dies (see FIG. 1). Thereafter, the movable die is shifted to the right and causes the blank to roll between the dies to form the threads. As the movable die reaches the extreme right end of its stroke, the newly threaded fastener falls out from between the dies and into a collecting hopper (not shown). The machine 10 operates at high speeds and is capable of threading more than 1,000 blanks per minute.

To deliver the blanks 11 to the dies 13 and 14, two parallel rails 22 and 23 (FIG. 1) form a slotted track 24 which extends rearwardly to a vibratory bowl (not shown). Blanks fed from the bowl gravitate down the track to a point adjacent the dies and are stopped by a pivotally mounted and spring-loaded gate 25 which extends across the downstream ends of the rails. Each time the movable die 14 is retracted, a feed finger 26 engages the leading blank and pushes the latter past the escapement gate 25 and into the gap between the dies. The feed finger is carried on one end portion of a slide 27 which is mounted for reciprocation in a guideway 29 on the base plate 17.

As shown in FIG. 1, the feed finger 26 is disposed at an angle of about 45 degrees with respect to the dies 13 and 14. Also, the tips 30 and 31 of the rails 22 and 23 are beveled at an angle of 45 degrees to enable the feed finger to be located in face-to-face relation with the tips. The rail 23 is located such that the extreme corner 32 of its tip 31 is positioned closely adjacent the forward leading corner 33 of the fixed die 13 and, in effect, forms an angled continuation of the upper edge 34 of the thread forming face 15 of the fixed die. The angular disposition of the feed finger 26 and the relationship between the rail tip 31 and the die edge 34 is important to facilitate movement of the blank 11 out of the track 24 and around the forward leading corner 33 of the fixed die 13. If the relationship between the rail tip 31 and the die edge 34 is not maintained, the fastener blank either will hang up on the forward leading corner 33 of the fixed die or there will not be sufficient clearance to enable the blank to enter the gap between the two dies 13 and 14.

Figure 2:
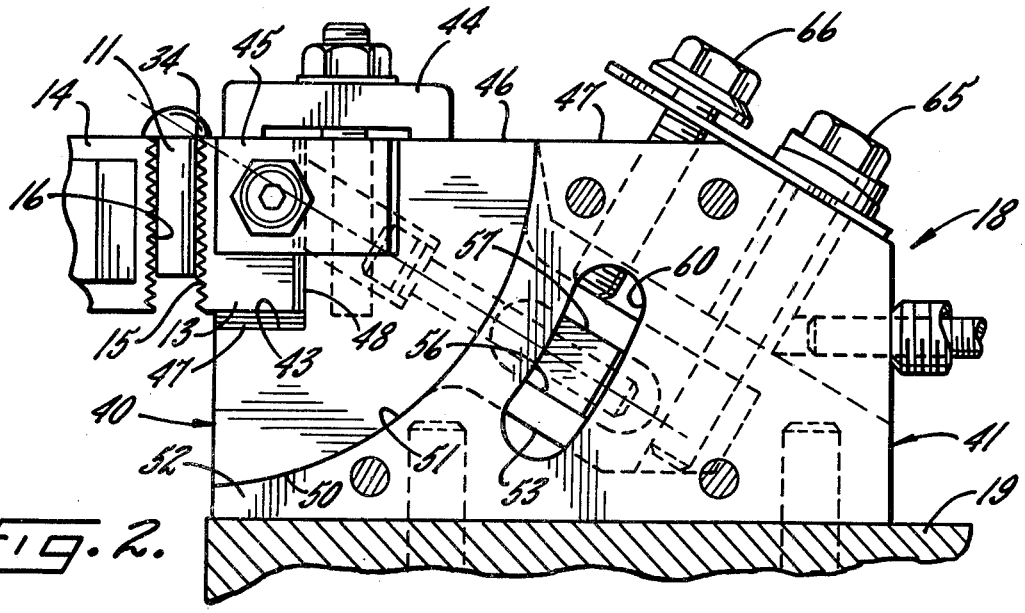
FIG. 2 is a fragmentary cross-section taken substantially along the line 2—2 of FIG. 1 and shows the machine threading a fastener blank of a particular shape.
Figure 3:
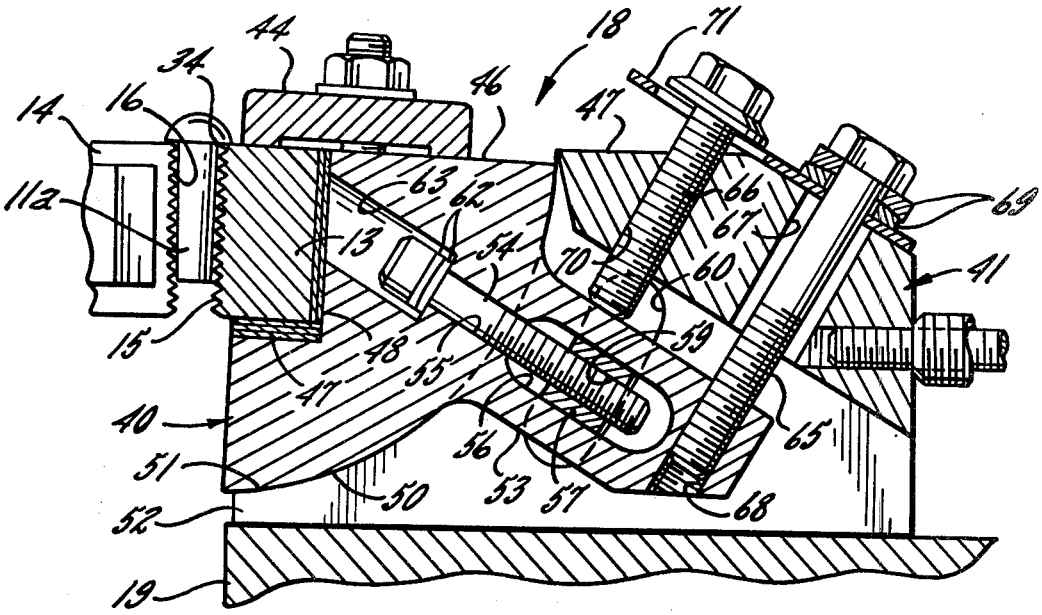
FIG. 3 is a fragmentary cross-section taken substantially along the line 3—3 of FIG. 1 but shows the machine threading a fastener blank of a different shape and shows certain parts of the die holder in moved positions.

One of the problems encountered in the precision thread rolling art is that batches of fastener blanks which are nominally of the same size may have different shapes. The fastener blanks usually are made on a cold forming machine. When the dies of such a machine are new, the shanks of the blanks are virtually cylindrical, that is, each shank is of virtually uniform diameter from is head to its tip as exemplified by the blank 11 which is shown in FIG. 2. As the dies of the cold forming machine become worn, the shanks may be formed with a downwardly progressing taper. A blank 11a with an exaggerated taper is illustrated in FIG. 3 and, as shown, the diameter of the head end of the shank is about the same as that of the blank 11 but the diameter diminishes as the shank progresses downwardly.

Because the thread rolling machine 10 may be supplied with batches of blanks which differ in shape from batch to batch, it is necessary to adjust the relative position of the dies 13 and 14 in accordance with the shape of any given batch. For example, if the machine 10 has been set up to run blanks 11 with cylindrical shanks and then is supplied with blanks 11a having tapered shanks, it is necessary to tilt the stationary die 13 so that the lower portion of its thread forming face 15 is moved toward the lower portion of the thread forming face 16 of the movable die 14. Such tilting causes the gap between the dies to assume a tapered shape assimilating that of the blanks 11a (see FIG. 3) and enables the blanks to be properly threaded.

In tilting the stationary die 13, care must be taken not to disturb the precise relationship between the upper edge 34 of the die and the tip 31 of the feed rail 23 since this relationship is important to enable proper feeding of the blanks. Heretofore, tilting of the stationary die has been effected by placing appropriately shaped shims beneath and behind the die. This involves time consuming, trial and error set up procedures and, in many instances, the operator fails to maintain the precise relationship between the die and the feed rail 23.

In accordance with the present invention, the die holder 18 is uniquely constructed to enable the fixed die 13 to be tilted quickly and easily to different positions without need of shimming the die and without changing the relationship between the tip 32 of the feed rail 23 and the upper edge 34 of the die. This is achieved through the provision of a die holder having two relatively adjustable blocks 40 and 41, the block 40 holding the die 13 and being adjustably supported on the block 41 in such a manner as to enable the die 13 to be tilted about an axis which coincides with the upper edge 34 of the die.

More specifically, the block 41 constitutes a fixed mounting block and is supported directly on the plate 19. The block 40 is supported on but is adjustable relative to the forward side of the block 41 and is formed with a pocket 43 (FIG. 2) for receiving the die 13. A clamp 44 and an adjustable stop 45 engage the top and one end of the die and hold the latter in the pocket.

When the stationary die 13 is oriented such that its thread forming face 15 is in a vertical plane, the upper surfaces 46 and 47 of the adjustable and fixed blocks 40 and 41 are disposed in a common horizontal plane (see FIG. 2). In addition, the die 13 is positioned so that its upper surface is disposed in the same horizontal plane and so that its upper edge 34 is spaced a predetermined distance from the rear wall of the pocket 43. The die may be properly positioned within the pocket by placing shims 47 (FIG.2) beneath the die and by placing additional shims 48 behind the die. Once stalled, the shims 47 and 48 remain in place as long as a die of a given size is being used and thus these shims are to be distinguished from shims which previously were used to effect tilting of the die. The purpose of the shims 47 and 48 is simply to locate a die of a given size in a predetermined position in the pocket 43 of the block 40.

In carrying out the invention, the blocks 40 and 41 are formed with mating arcuate surfaces which anable the fixed die 13 to be tilted without effecting a change in the position of the upper edge 34 of the die. As shown in FIG. 2, the lower surface 50 of the adjustable block 40 is arcuate and defines a convexly curved rocker surface. The axis or center of curvature of the rocker surface 50 lies along and coincides with the upper edge 34 of the thread forming face 15 of the fixed die 13 and thus each point of the rocker surface 50 is spaced equidistantly from the upper die edge 34.

Figure 4:
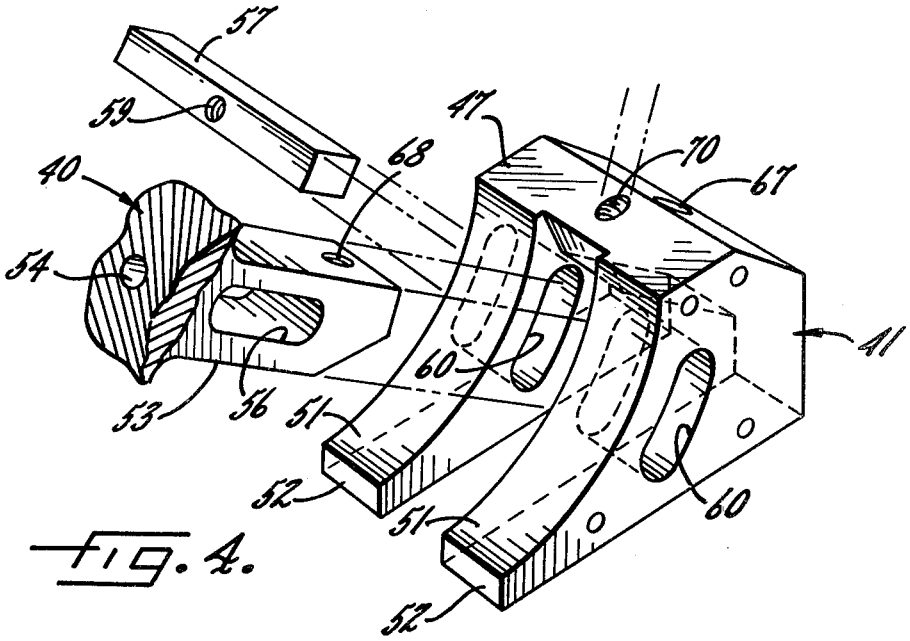
FIG. 4 is an exploded perspective view of parts of the die holder.

The fixed mounting block 41 is formed with a concavely curved arcuate seat which is concentric with the rocker surface 50. Herein, the arcuate seat is defined by the curved upper surfaces 51 (FIG. 4) of a pair of laterally spaced legs 52 which define the sides of the block 41. The axis of the surfaces 51 also lies along the upper edge 34 of the fixed die 13 and such surfaces are curved on virtually the same radius as the convex rocker surface 50.

The adjustable block 40 is supported on the mounting block 41 such that the convex rocker surface 50 of the adjustable block is disposed in face-to-face contact with the seat defined by the concave surfaces 51 of the legs 52 of the mounting block. When the block 40 is moved to cause the surface 50 to slide along the surfaces 51, the thread forming face 15 of the fixed die 13 is tilted into a different plant but such tilting does not change the position of upper edge 34 of the die since the tilting occurs about an axis which corresponds to the upper edge 34.

To secure the blocks 40 and 41 together while permitting adjustment of the block 40, a rearwardly projecting tongue 53 (FIGS. 3 and 4) is formed integrally with the block 40 and extends into the space between the legs 52 of the fixed block 41. An elongated threaded member in the form of a screw 54 projects through a hole 55 in the block 40 and extends into an elongated slot 56 formed through the tongue 53. A laterally extending retainer 57 is located in the slot and is formed with a tapped hole 59 for threadably receiving the screw 54. The end portions of the retainer project into arcuate slots 60 which are formed in the fixed block 41 adjacent the legs 52. Each slot 60 is formed with an arcuate and convexly curved forward side which is concentric with the surfaces 50 and 51. The forward side of the retainer 57 is formed with a concave curvature to enable the retainer to mate face-to-face with the forward surfaces of the slots 60.

By tightening the screw 54, the retainer 57 may be drawn forwardly in the slot 56 in the tongue 53 until the forward side of the retainer tightly engages the forward surfaces of the slots 60 in the block 41. The screw 54 and the retainer 57 thus enable the rocker surface 50 to be drawn downwardly and rearwardly into snug engagement with the curved surfaces 51 so as to prevent the block 40 from separating from the block 41 during operation of the thread rolling machine 10. Means are, however, provided to enable the block 40 to be adjusted along the block 41 without need of loosening the screw 54. Herein, these means comprise a pair of Belleville springs 62 (FIG.3) which are telescoped over the screw and which are located between the head of the screw and the bottom of a counterbore 63 formed in the block 40. When the screw 54 is tightened, the springs 62 are loaded and urge the screw forwardly so as to bias the retainer 57 into engagement with the forward surfaces of the slots 60. While the springs coact with the screw to keep the surface 50 tightly against the surfaces 51, the springs are sufficiently yieldable to permit the surface 50 to slide along the surfaces 51 when it is necessary to tilt the fixed die 13.

The fixed die 13 is normally held in a stationary position but is adapted to be selectively tilted by means of a locking screw 65 (FIG. 3) and an adjusting screw 66. As shown in FIG. 3, the locking screw 65 extends through an enlarged hole 67 formed in the fixed block 41 and is threaded into a tapped hole 68 formed in the tongue 53 of the adjustable block 40. Spherical washers 69 are located beneath the head of the locking screw 65 and permit that screw to tilt within the enlarged hole 67 when the tongue 53 is pivoted upwardly and downwardly during adjustment of the die 13.

The adjusting screw 66 is threaded into a hole 70 (FIG.3) in the fixed block 41 and its lower end bears against the upper side of the tongue 53. A plate 71 (FIG. 1) preferably underlies the head of the adjusting screw and is formed with a scale 72 which coacts with a pointer 73 on the head of the adjusting screw. The scale may be calibrated to indicate the tilt angle of the fixed die 13 and may be read by the operator of the machine 10 when it is necessary to adjust the die.

In order to explain the manner of tilting the die 13, let it be assumed that the machine 10 has been running cylindrical blanks 11 and that the fixed die 13 has been positioned with its thread forming face 15 disposed in a vertical plane as shown in FIG. 2. Let it further be assumed that it is necessary to set up the machine to run tapered blanks 11a and that it thus is necessary to adjust the fixed die to tilt the lower portion of its thread forming face toward the movable die 14 as shown in FIG. 3.

To effect such adjustment, the locking screw 65 first is loosened to free the adjustable block 40 to move in a clockwise direction (FIGS. 2 and 3). Thereafter, the adjusting screw 66 is tightened and its lower end forces downwardly against the tongue 53 to pivot the block 40 clockwise on the curved surfaces 51 of the block 41. The die 13 thus is tilted in the desired direction but its upper edge 34 remains stationary and stays in a fixed position relative to the tip 31 of the rail 23. As the screw 66 is tightened, the springs 62 enable the block 40 to move along the block 41 even though the two blocks are held in engagement by the screw 54. By virtue of the springs 62, the screw 54 can be tightened when the two blocks are initially assembled and need not be loosened when the block 40 is subsequently adjusted. When the block is adjusted, the retainer 57 travels in the arcuate slots 60.

The operator of the machine 10 may determine when the die 13 has been adjusted to its desired position by reading the scale 72. Thereafter, the locking screw 65 may be tightened to hold the die in its adjusted position.

To tilt the die 13 in the opposite direction, the adjusting screw 66 is loosened until the pointer 73 reaches a desired position on the scale 72. The locking screw 65 then is tightened to draw the tongue 53 upwardly into engagement with the adjusting screw, the die 13 being tilted in a counerclockwise direction during tightening of the locking screw.

From the foregoing, it will be apparent that the present invention brings to the art a new and improved die holder 18 which enables the stationary die 13 to be tilted quickly and easily without changing the position of the upper edge 34 of the die. Such tilting is made possible as a result of the surfaces 50 and 51 being uniquely curved about an axis which lies along the upper edge 34 of the die. By virtue of the invention, the die can be tilted in less time and with greater precision than has been possible heretofore and thus machine set up time is significantly reduced.

I claim:

1. A holder for the stationary die of a thread rolling machine, said die including a thread forming face having upper and lower edges, said holder comprising a mounting block and an adjustable block suppoted on said mounting block, said die being supported on said adjustable block, said mounting block being formed with a concavely arcuate seat having an axis coinciding with the upper edge of the thread forming face of said die, said adjustable block having a convexly curved surface concentric with said seat and disposed in engagement with said seat, means for securing said adjustable block to said mounting block to hold said surface in engagement with said seat while permitting said surface to slide along said seat, and selectively adjustable means connected between said blocks and operable when adjusted to cause said surface to slide along said seat thereby to tilt the thread forming face of said die without changing the location of the upper edge of said thread forming face.

2. A holder as defined in claim 1 in which said securing means comprises an elongated, externally threaded member extending non-threadably through said adjustable block, a pair of slots formed in said mounting block on opposite sides of said threaded member and each having an arcuate edge concentric with said seat, a retainer on one end portion of said threaded member and projecting into said slots, said retainer being drawn into engagement with the arcuate edges of said slots when said threaded member is tightened, and resilient means telescoped over said threaded member and urging said surface into engagement with said seat.

3. A holder as defined in claim 1 in which said securing means comprises a screw extending non-threadably through a portion of said adjustable block, a retainer threadably receiving said screw, a pair of slots formed in said mounting block on opposite sides of said screw and each having an arcuate edge concentric with said seat, said slots receiving said retainer, said retainer being drawn into engagement with the arcuate adges of said slots when said screw is tightened, and resilient means telescoped over said screw and urging said surface into engagement with said seat.

4. A holder as defined in any of claim 1, 2 or 3 in which said adjustable means comprises an adjusting screw threaded through said mounting block and having an end which engages said adjustable block, said adjusting means further comprising a locking screw extending loosely through said mounting block and threaded into said adjustable block.

* * * * *